US009289346B2

(12) United States Patent
Demski et al.

(10) Patent No.: US 9,289,346 B2
(45) Date of Patent: Mar. 22, 2016

(54) ERGONOMIC CRUTCH

(71) Applicant: Wisys Technology Foundation, Inc., Madison, WI (US)

(72) Inventors: Nathan Robert Demski, Dubuque, IA (US); Ryan Matthew Fickau, Manitowoc, WI (US); Derek Stanley Lewan, Dubuque, IA (US); Luke Benjamin Dykstra, Manitowoc, WI (US); Michael James Glodowski, Amherst, WI (US); Robert Limoni, Green Bay, WI (US)

( * ) Notice: Subject to any disclaimer, the term of this patent is extended or adjusted under 35 U.S.C. 154(b) by 0 days.

(21) Appl. No.: 14/063,101

(22) Filed: Oct. 25, 2013

(65) Prior Publication Data

US 2014/0116484 A1 May 1, 2014

Related U.S. Application Data

(60) Provisional application No. 61/718,843, filed on Oct. 26, 2012, provisional application No. 61/721,555, filed on Nov. 2, 2012.

(51) Int. Cl.
*A61H 3/02* (2006.01)

(52) U.S. Cl.
CPC ..... *A61H 3/02* (2013.01); *A61H 2003/0211* (2013.01); *A61H 2201/1614* (2013.01)

(58) Field of Classification Search
CPC ... A61H 3/02; A61H 3/00; A61H 2201/1635; A61H 2003/006; A61H 2003/0211; A61H 2003/0233
USPC ..... 135/65, 68, 69, 71–73, 76; 482/67, 69; D3/5–8
See application file for complete search history.

(56) References Cited

U.S. PATENT DOCUMENTS

| | | | | | |
|---|---|---|---|---|---|
| 2,552,902 | A * | 5/1951 | Miley et al. | 135/73 |
| 2,568,654 | A * | 9/1951 | Neptune | 135/69 |
| 2,811,978 | A * | 11/1957 | Russell | 135/65 |
| 3,635,233 | A * | 1/1972 | Robertson | 135/71 |
| 3,768,495 | A * | 10/1973 | Smith | 135/72 |
| 4,763,680 | A * | 8/1988 | Acosta, Sr. | 135/68 |
| 5,687,991 | A * | 11/1997 | Gairdner | 280/826 |
| 5,725,005 | A * | 3/1998 | Yamasaki et al. | 135/73 |
| 7,434,592 | B2 * | 10/2008 | Larson et al. | 135/73 |
| 7,610,926 | B2 | 11/2009 | Adams | |
| 7,717,123 | B2 * | 5/2010 | Weber et al. | 135/73 |
| 7,926,498 | B2 | 4/2011 | Weber et al. | |
| 8,056,571 | B2 | 11/2011 | Delacé | |
| 2003/0098052 | A1 * | 5/2003 | Fismer | 135/76 |
| 2011/0108075 | A1 * | 5/2011 | Weber | 135/72 |

FOREIGN PATENT DOCUMENTS

| | | | | |
|---|---|---|---|---|
| FR | 2703246 | A1 * | 10/1994 | A61H 3/02 |
| JP | 2000126253 | A * | 5/2000 | A61H 3/02 |
| WO | 2007027098 | A1 | 3/2007 | |

* cited by examiner

*Primary Examiner* — Winnie Yip

(74) *Attorney, Agent, or Firm* — Boyle Fredrickson, S.C.

(57) ABSTRACT

A medical crutch having a number of bends in the frame for redistributing the amount of pressure applied to a user's hand, arm, and axilla. The frame has a first jog outwardly sidewards relative to a user's body and a second jog outwardly forward relative to the user's body. The frame may attach an adjustable handle, forearm rest and underarm support, among other attachments. The frame is adapted to fit all average sizes by adjusting the positions of the attachments.

19 Claims, 6 Drawing Sheets

ERGONOMIC CRUTCH

CROSS REFERENCE TO RELATED APPLICATION

This application claims priority to U.S. provisional application Ser. No. 61/718,843, filed Oct. 26, 2012, and U.S. provisional application Ser. No. 61/721,555, filed Nov. 2, 2012, the entire contents of which are incorporated herein by reference.

BACKGROUND OF THE INVENTION

The present invention relates to medical crutches for supporting a human user's body weight, and in particular, to a medical crutch with a framework which disperses contact forces to multiple regions of the body.

The physical rehabilitation industry is a large industry sector related to enhancing and restoring functional ability and quality of life to those with physical impairments or disabilities. One of the greatest hurdles for those working within the physical rehabilitation field is providing proper equipment to a patient and ensuring that the equipment is being used properly. One of the major reasons found for improper use of equipment by patients is discomfort when using the equipment. Improper use of equipment can cause exacerbation of pre-existing injuries or conditions, as well as effectuate new injuries to arise.

One of the most commonly used pieces of equipment used in the physical rehabilitation industry are medical crutches. Medical crutches are used to carry and shift all or part of a user's body weight from one part of the body to another. Namely, crutches transfer weight from a user's lower body to their upper body. Two of the most commonly used types of crutches are axillary crutches and Lofstrand crutches. The axillary (or underarm) crutch usually has an axillary pad which is placed against the ribcage beneath the armpit, and a hand grip that is situated below and parallel to the axillary pad. This type of crutch is typically used by temporary crutch users because of the high amount of force shifted to the hand, arm, and axilla. On the other hand, the Lofstrand (or forearm) crutch does not extend to under or near the axilla. Instead, the top portion of the crutch has a cuff that goes around the forearm, and a hand grip situated below and near the cuff. This type of crutch is typically used by long-term crutch users but provides less overall support than axillary crutches and requires the user to maintain better balance.

Traditional axillary crutches transmit forces to the patient's hand, arm, and axilla. Forces at the crutch tip are intended to be primarily transferred directly to the hands and wrist, and only secondarily supported by the axilla. Supporting significant body weight on the axilla area can cause compression of sensitive nerves running through it. For example, many crutch users suffer from crutch paralysis when either the radial nerve or part of the brachial plexus containing various nerves that innervate sense and motor function to the hand and arm is under constant pressure from use of the crutch. Other serious conditions can also arise from crutch use, such as aneurysm and axillary artery thrombosis, from pressure placed on the user's axilla.

SUMMARY OF THE INVENTION

The present inventors have recognized that providing appropriate bends in the medical crutch frame can better redistribute the pressure applied to the user's hand, arm, and axilla. In addition, these changes increase crutch stride length and shock absorption, while also improving overall walking efficiency and aesthetic appeal. A number of improved attachments may also be secured to the crutch frame. The attachments are adjustable to provide a fitting particularly suited to a user's body size and dimensions.

Accordingly, the present invention provides a medical crutch having a frame with a number of bends which place the frame outwardly sidewards and outwardly forward relative to the user's body. Moreover, a S-bend places the frame outwardly forward relative to the user's body and backward relative to the user's body. Both the location and sequence of the bends provides a redistribution of weight to prevent user injury, while still providing a stabilizing crutch.

In one embodiment, the present invention may be a medical crutch for a human comprising an elongated rod having a first end positioned underneath an axilla of a user and extending a length commensurate with a distance between the axilla of the user and a ground to a second end when the user is standing upright on the ground. The elongated rod extends downward from the axilla to a first jog outwardly sidewards relative to a user's body and a second jog outwardly forward relative to the user's body. An axillary pad may extend from the first end of the elongated rod and may be sized to fit underneath the user's axilla. An arm support may be sized to receive an average user's forearm. A crutch foot may extend from the second end of the elongated rod to contact the ground at a slip resistant face.

It is thus a feature of at least one embodiment of the invention to decrease the weight bearing load on the user's axilla by moving the placement of the crutch tip with respect to the axilla and creating other weight distribution surfaces.

A S-curve formed in the elongate rod may have a first bend outwardly forward relative to the user's body and a second bend backward relative to the user's body. The S-curve may be positioned forward relative to a user's arm when the user's forearm is received in the arm support.

It is thus a feature of at least one embodiment of the invention to provide additional bends to position the crutch to the front and side of the user, but also not interfere with the user's feet during use.

The elongated rod's second jog may include a straight portion angled outwardly forward and down for a length substantially equal to the length of the user's forearm.

It is thus a feature of at least one embodiment of the invention to provide an arm supporting surface at a comfortable angle consistent with the arm's natural extension and bend.

The first jog and second jog may be positioned below the user's axilla and above the user's forearm when the user's forearm is received in the arm support.

It is thus a feature of at least one embodiment of the invention to displace the crutch away from the axilla near the bend of the user's elbow.

The underarm support may be an elastic mesh. The underarm support may be rotatable about an axis along the upper end of the elongate rod.

It is thus a feature of at least one embodiment of the invention to provide additional comfort to the user and distribute the forces to prevent pressure points on the axilla.

The crutch foot may be an elastomeric material having a plurality of holes extending horizontally when the crutch is positioned upright. The crutch foot may have a hemi-cylindrical bottom surface having a curvature axis sidewards relative to a user's body and wherein the bottom surface has traction grooves extending sidewards relative to a user's body It is thus a feature of at least one embodiment of the invention to increase the elasticity and shock absorption of the crutch and improve ground traction to prevent slippage.

The elongated rod may receive the arm support below the first jog and the second jog.

It is thus a feature of at least one embodiment of the invention to provide the arm support at the user's forearm when the elbow is at a comfortable bend.

The elongated rod may be constructed of a material from a group comprising fiberglass reinforced plastic, carbon fiber, and aluminum.

It is thus a feature of at least one embodiment of the invention to maintain strength while considering cost, flexibility, and weight of the rod.

These particular objects and advantages may apply to only some embodiments falling within the claims and thus do not define the scope of the invention.

DETAILED DESCRIPTION OF THE INVENTION

Figure 1:
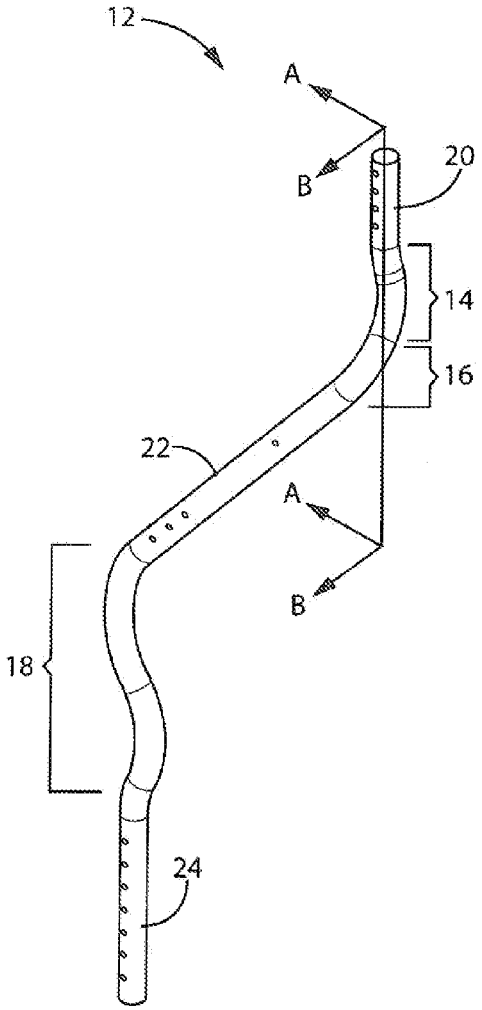
FIG. 1 is a perspective view of a simplified medical crutch frame without any attachments.

Referring now to FIG. 1, a medical crutch 10 is comprised of a crutch backbone 12 that may be constructed of a light yet rigid material, for example, fiberglass reinforced plastic, carbon fiber, or aluminum. The backbone 12 is shaped to provide an outward jog 14, a forward jog 16, and a S-bend 18 to aid absorption of the energy transferred by the user. The bends are bounded by three generally straight portions in the backbone 12: an upper section 20, a middle section 22, and a lower section 24, which also provide attachment means for the various support structures of the medical crutch 10.

Figure 4:
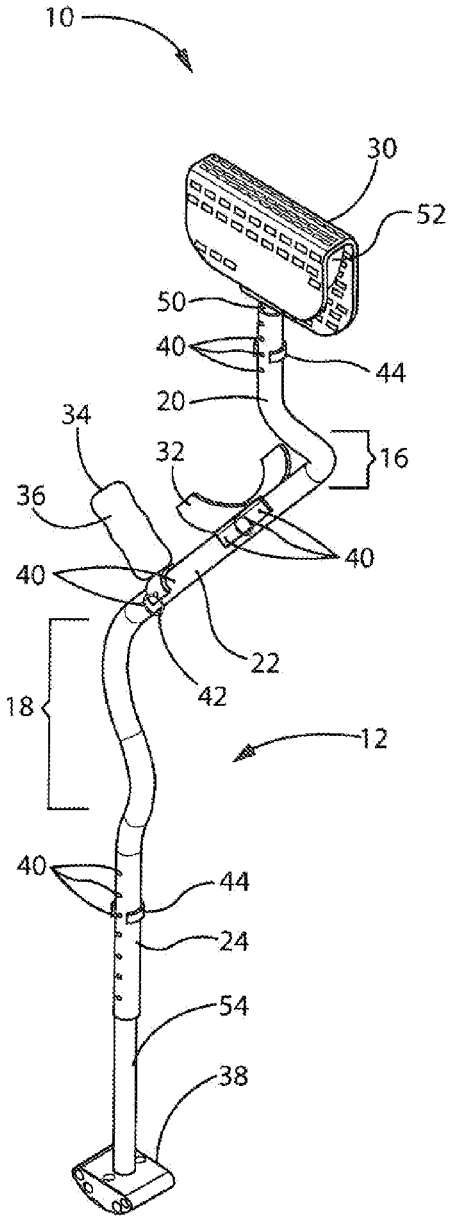
FIG. 4 is a perspective view of a right side medical crutch with underarm frame, forearm rest, crutch handle, and foot attachments.

As seen in FIGS. 1 and 4, the backbone 12 is first defined by an upper section 20 that is generally straight and contains receiving holes 40 for a pinned c-dip 44. The top of the upper section slidably receives an underarm support pole 50 attached to an underarm frame 52 to be fitted underneath the user's arm during use. The underarm support pole 50 and underarm frame 52 will be described in further detail below.

Figure 2:
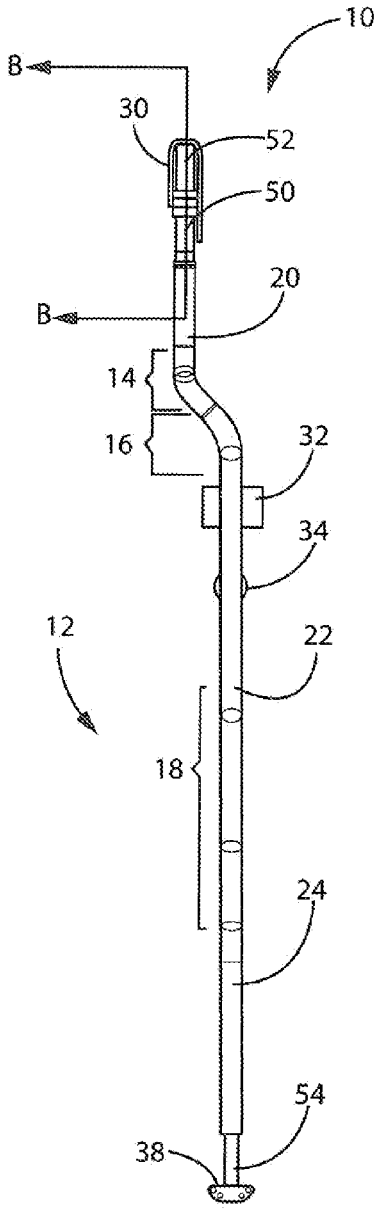
FIG. 2 is an elevation view of a right side medical crutch taken along lines B-B of FIG. 1 with underarm frame, forearm rest, crutch handle, and foot attachments.
Figure 6:
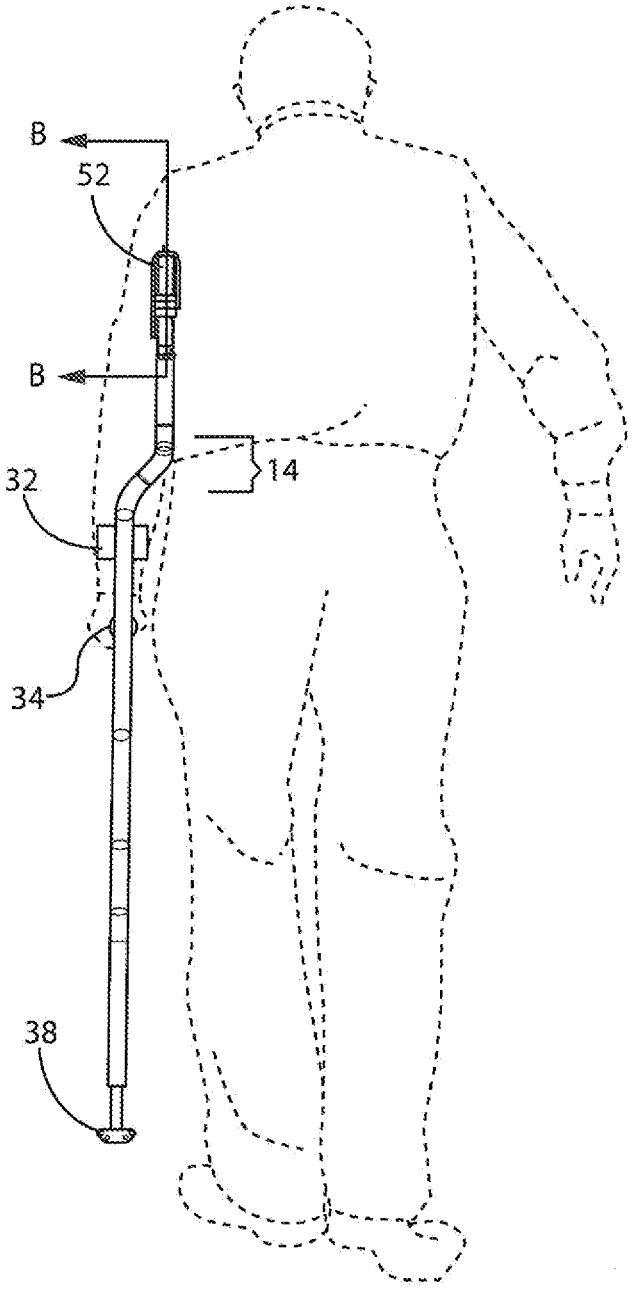
FIG. 6 illustrates use of a medical crutch taken along lines B-B of FIG. 4 showing a left side medical crutch positioned under a user's arm.

Referring now to FIG. 2, disposed below the upper section 20 is an outward jog 14 which is defined by a bend in the backbone 12 in a direction outward and to the side of the user's body. Depending upon which side of the body the crutch 10 is to be used, left side or right side, the outward jog 14 will be bent in opposite mirrored positions, left side or right side, respectively. As depicted in the right side crutch of FIG. 2, the outward jog 14 of a right side crutch is bent outward to the right of the user's body. Alternatively, and as seen in FIG. 6, the outward jog 14 of a left side crutch is bent outward to the left of the user's body. The outward jog 14 shifts the position of the backbone 12 out from vertical alignment with the user's axilla and closer to vertical alignment with the user's arm.

Figure 3:
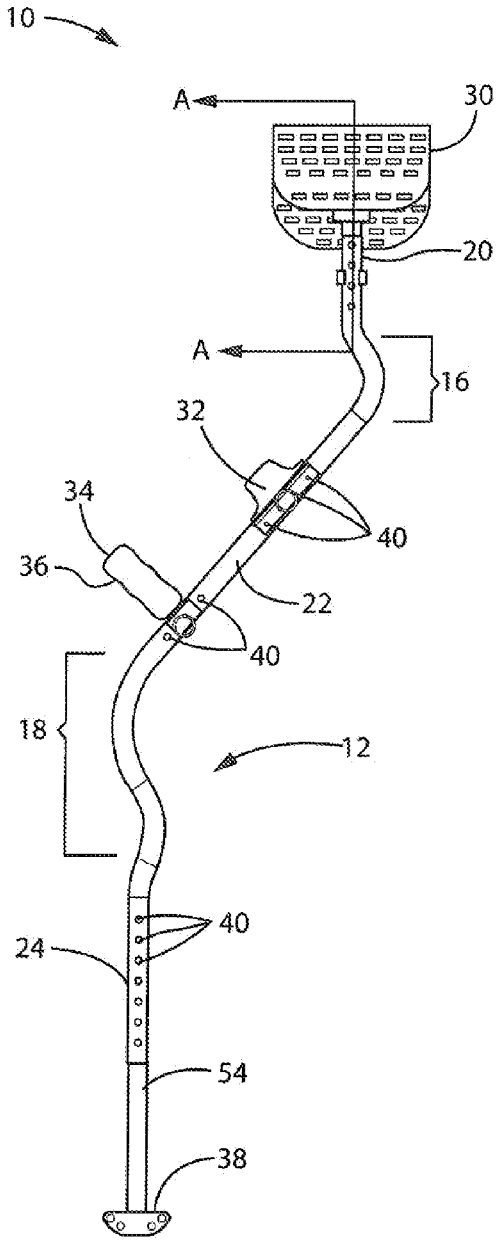
FIG. 3 is an elevation view of a right side medical crutch taken along lines A-A of FIG. 1 with underarm frame, forearm rest, crutch handle, and foot attachments.

Referring now to FIG. 3, disposed below the outward jog 14 is the forward jog 16 which is defined by a bend in the backbone 12 in a direction forward to the user's body. The forward jog 16 shifts the backbone 12 in alignment with a user's arm when the arm is extended outward at a downward angle. The outward jog 14 and forward jog 16 act to provide additional load bearing surfaces and to position the backbone 12 in a more comfortable position.

The bend continues to a middle section 22. The middle section 22 of the backbone 12 is generally straight and disposed at an outward angled position with respect to the user's body. The middle section 22 may be disposed at, for example, a 30-degree or 50-degree angle from horizontal. It is contemplated that the middle section 22 may be disposed at other desired angles. The middle section 22 contains receiving holes 40 for an adjustable forearm rest 32 and receiving holes 40 for a crutch handle 34. The forearm rest 32 and crutch handle 34 will be described in further detail below.

Referring still to FIG. 3, disposed below the middle section 22 is a S-bend 18 which is shaped like the letter "S" and curves the outwardly angled middle section 22 inward toward the user's body and then outward away from the user's body. The first curve is C-shaped and transitions directly into the second curve which is a reversed-C shape. The S-bend 18 shifts the backbone 12 back to a straight vertical position in order to contact the ground. The S-bend 18 continues to the lower section 24.

As seen in FIGS. 1 and 4, the lower section 24 of the backbone 12 is generally straight and contains receiving holes 40 for a pinned c-clip 44. The bottom of the lower section 24 slidably receives a bottom support pole 54 attached to a crutch foot 38 that contacts the ground during use. The bottom support pole 54 and crutch foot 38 will be described in further detail below.

Referring now to FIG. 4, the backbone 12 has a plurality of holes 40 for the various support structures that may be added to the crutch 10. The upper section 20 of the backbone 12 contains a plurality of holes 40 which are disposed in a vertical arrangement as to allow a pinned c-clip 44 to be inserted at varying height positions. The upper section 20 of the backbone 12 slidably receives an underarm support pole 50 which in turn is attached to an underarm frame 52. The height of the underarm frame 52 may be adjusted by sliding the underarm support pole 50 vertically within the upper section 20 until a desired height is reached. The underarm frame 52 is then secured at the desired height by securing the c-clip 44 with a pin into a selected hole 40 of the backbone 12 and an attachment hole 70 at a lower end of the underarm support pole 50.

Figure 4A:
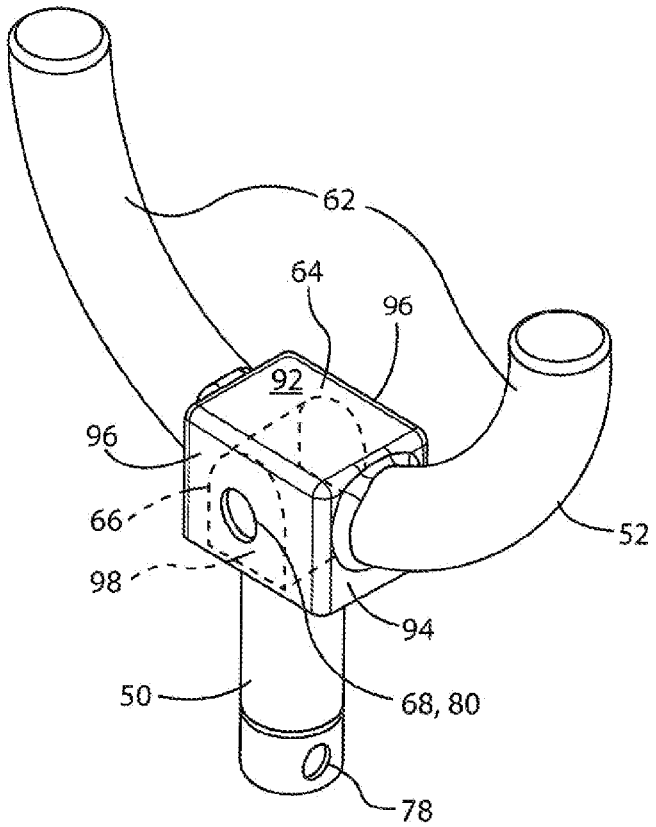
FIG. 4*a* is an enlarged perspective view of the underarm frame attachment of FIG. 4 without the crutch pad covering.

As seen in FIG. 4*a*, the underarm frame 52 is defined by two upwardly bended arms 62 forming a generally wide U-shape and joined at an enclosure 64 for receiving a support swivel 66 within. The enclosure 64 has a plurality of walls defining a rectangular volume including four sidewalls extending downward from an upper sidewall 92 defining a ceiling. The two upwardly bended arms 62 extend upward from a left and right sidewall 94 of the enclosure 64. A front and back sidewall 96 each contain a pivot hole 68 for receiving a pin or bolt.

A support swivel 66 is sized to fit within the inner volume of the enclosure 64 and is inserted into a bottom open end of the enclosure 64. The support swivel 66 has a curved top portion extending a width left and right and flanked by generally flat front and back faces 98. The support swivel 66 is secured to the enclosure 64 by inserting a pin or bolt through the pivot holes 68 of the front and back sidewalls 96 of the enclosure 64 and a pivot hole 80 of the support swivel 66 which extends between the front and back faces 98. The curved top portion of the support swivel 66 allows for rotational movement of the underarm frame 52 in a left and right direction. The underarm support pole 50 is secured to a flat bottom surface of the support swivel 66 The underarm support pole 50 has an attachment hole 70 at a lower end for receiving a c-clip 44 to secure the underarm support pole 50 to the upper section 20 of the backbone 12 as described herein.

The underarm frame 52 may be covered by a crutch pad 30 extending over and around the upwardly bended arms 62. The crutch pad 30 may be constructed of an elastic mesh material and shaped to provide proper weight distribution. While mesh material may be used, it is contemplated that other elastic materials may be used, such as a gel pad, which allow vertical compression of the crutch pad 30 so that it is more comfortable to the user and can better mold to the contours of the user's axilla. However, the crutch pad 30 retains its overall shape so as to prevent pressure points on particular areas of contact. The size of the crutch pad 30 is contemplated to provide a large surface area so that there is greater weight distribution onto the pad 30 and less pressure is placed on the sensitive nerves of the axilla. The size of the crutch pad 30 may be approximately 7-inches long by 4.25-inches tall by 1.50-inches wide.

Figure 4B:
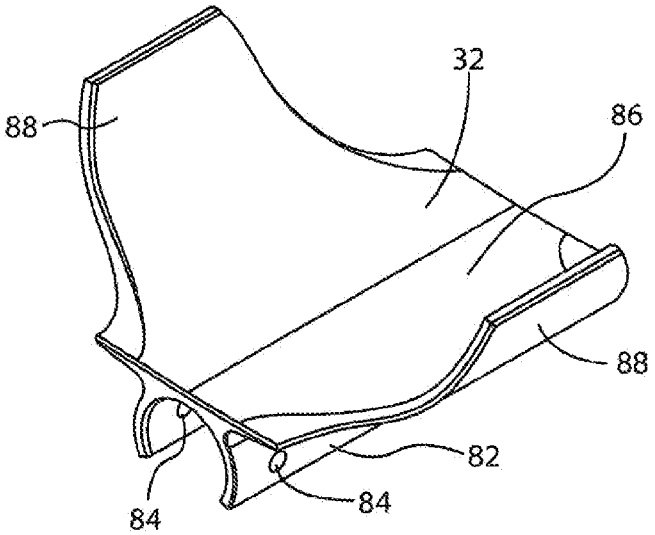
FIG. 4*b* is an enlarged perspective view of the forearm rest attachment of FIG. 4.

The middle section 22 of the backbone 12 contains a plurality of holes 40 disposed at varying vertical and horizontal positions along the angle-defined middle section 22. The top of the middle section 22 receives a forearm rest 32, as seen in FIG. 4*b*, which is constructed of a plastic material, e.g., Acrylonitrile butadiene styrene. The forearm rest 32 has a forearm rest base 82 that snap fits around the middle section 22 and is secured with a detent pin 42 placed in one of the receiving holes 40 of the middle section 22 and an attachment hole 84 within the forearm rest base 82. The forearm rest's 32 position can be adjusted to the user's arm length by securing the detent pin 42 at different hole 40 locations of the middle section 22. The forearm rest 32 has a supporting surface 86 that is a curved arc-shape to comfortably receive an average sized forearm and having sidewalls 88 to retain the forearm within the forearm rest 32. The forearm rest 32 may be 4-inches long and the sidewalls 88 may span a width of approximately 5-inches wide. The forearm rest 32 may be covered by a pad to provide better comfort to the user.

Figure 4C:
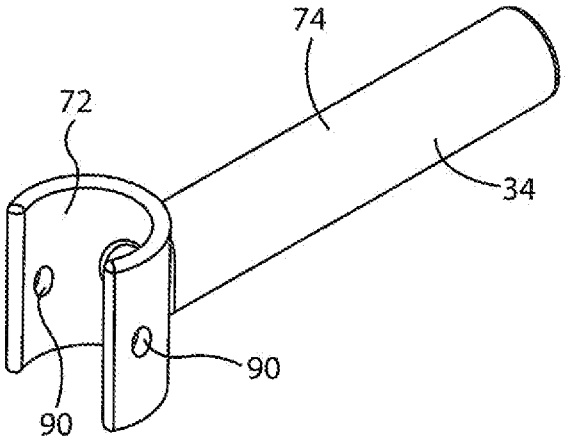
FIG. 4*c* is an enlarged perspective view of the crutch handle attachment of FIG. 4 without the handle pad covering.

As seen in FIG. 4*c*, the lower end of the middle section 22 receives a crutch handle 34 which is constructed of a plastic material, e.g. Acrylonitrile butadiene styrene. A handle base 72 snap fits around the middle section 22 and is secured with a detent pin 42 placed in one of the receiving holes 40 of the middle section and an attachment hole 90 within the handle base 72. A rod 74 extends from the handle base 72 to provide a graspable surface for a user's hand. The rod 74 may have a length of approximately 4.62-inches and a diameter of 0.75-inches. The crutch handle 34 can be adjusted to the user's arm length by securing the detent pin 42 at different hole 40 locations of the middle section 22. The crutch handle is covered by a handle pad 36 which may be constructed of a mesh fabric material to provide a soft comfortable grip to the user.

Referring still to FIG. 4, the lower section 24 of the backbone 12 contains a plurality of holes 40 which are disposed in a vertical arrangement as to allow a pinned c-clip 44 to be inserted at varying height positions. The lower section 24 of the backbone 12 slidably receives a bottom support pole 54 attached at a bottom end to a crutch foot 38. The height of the lower section 24 may be adjusted by sliding the bottom support pole 54 vertically within the lower section 24 until a desired height is reached. The bottom support pole 54 is then secured at the desired height by securing the c-clip 44 with a pin into the selected receiving hole 40 and an attachment hole 76 at a top end of the bottom support pole 54.

Figure 4D:
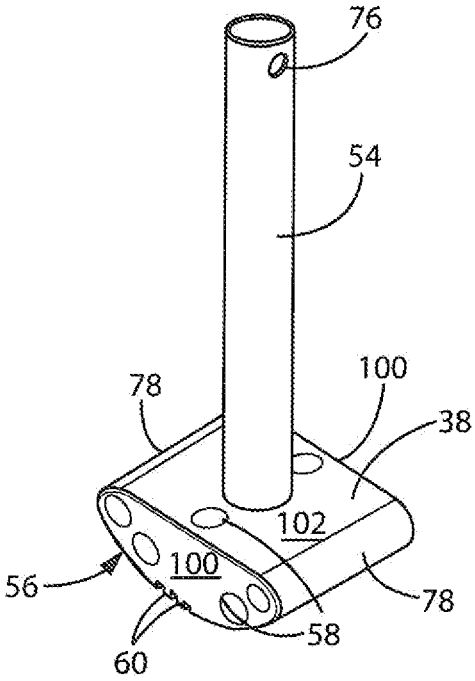
FIG. 4*d* is an enlarged perspective view of the foot attachment of FIG. 4.

As seen in FIG. 4*d*, the bottom support pole 54 has an attachment hole 76 at an upper end and is coupled to a crutch foot 38 on a bottom end. The crutch foot 38 is constructed of an elastomeric material, such as a rubber or neoprene material, and shaped to provide traction on different surfaces and terrains. For example, the crutch foot 38 may be made of a neoprene material having a durometer of 70 A. The flexibility of the crutch foot 38 allows the crutch foot 38 to act as a shock absorber for the entire crutch 10 apparatus. The crutch foot 38 has a hemi-cylindrical bottom face 56 having a curvature axis sidewards relative to a user's body and which contacts the ground throughout the user's stride. A wider surface bottom face 56 is used to distribute the user's weight and to prevent unwanted sliding in a direction perpendicular of desired motion. The curved bottom face 56 extends upward to define side walls 78 in a direction forward and backward of a user's stride. The adjacent side walls 100 of the crutch foot 38 are generally flat. Holes 58 that extend horizontally when the crutch 10 is upright may be placed in the adjacent side walls 100, and holes 58 that extend vertically when the crutch 10 is upright may be placed in a top wall 102 of the crutch foot 38 to reduce weight and amplify compression of the foot 38. Treads or grooves 60 extending sidewards relative to a user's body may be molded into the bottom face 56 to ensure maximum traction.

The crutch foot 38 is positioned to be offset from the user's feet so that it rests slightly in front of the user's feet during use. This allows the crutch foot 38 to not interfere with the user's stride while still allowing it to have a wider contact face 56.

Figure 5:
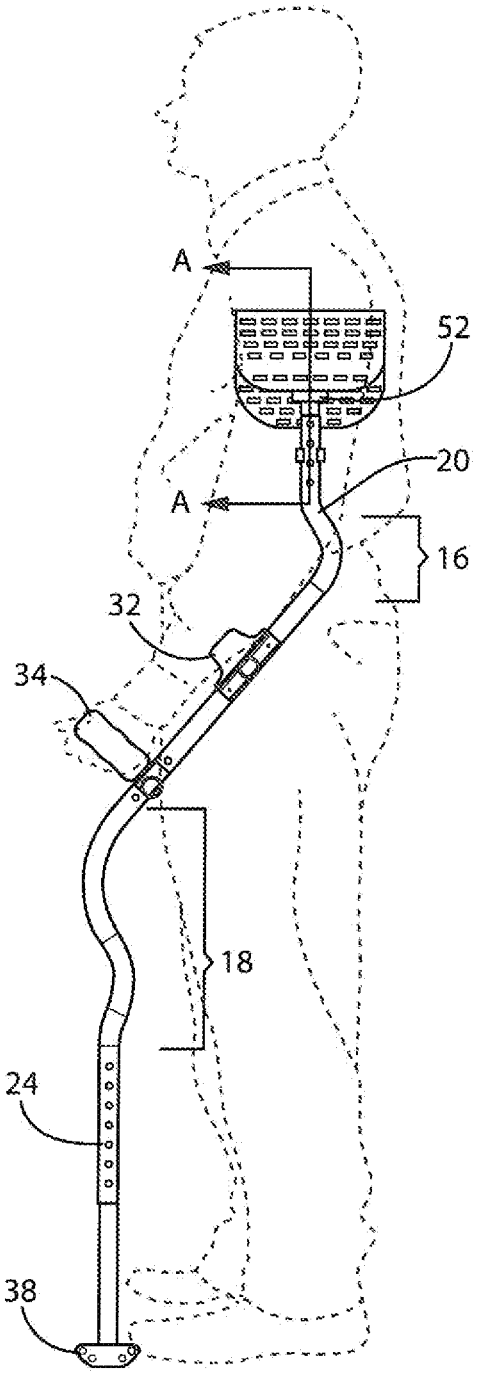
FIG. 5 illustrates use of a medical crutch taken along lines A-A of FIG. 4 showing a left side medical crutch positioned under a user's arm.

Referring now to FIGS. 5 and 6, the crutch 10 is used by placing the appropriately oriented crutch, left side or right side, underneath the axilla or armpit of the corresponding, left or right, arm. The underarm frame 52 is fitted underneath the axilla or armpit. The user then orients their arm in a forwardly downward position and places their forearm into the forearm rest 32 so that it is supported within. Lastly, the user will grip the crutch handle 34 with their hand. The underarm support pole 50 and bottom support pole 54 may be adjusted vertically so that the height of the underarm frame 52 corresponds with the height of the user's axilla. The attachments, forearm rest 32 and crutch handle 34, are adjusted to the length of the user's arm. Namely, the forearm rest 32 is positioned at a middle section of the user's forearm and the crutch handle 34 is positioned at a position consistent with the user's hand when the forearm is in the forearm rest 32. It has been contemplated that the same backbone 12 can be used for users within an average height range, for example, between 5'-5" to 6'-6", by adjusting the positions of the attachments and/or the height of the crutch 10.

Referring now to FIG. 5, the forward jog 16 is defined by a bend that shifts the backbone 12 from a position adjacent and to the side of the user's underarm, to a position forward of the user's arm. The forward jog 16 may place the middle section 22 at a forwardly downward angle, for example, at an approximately 30-degree angle or 50-degree angle with respect to horizontal. The middle section 22 extends an outward length to shift the backbone 12 forward of the user's body approximately 10-inches in front of the user's axilla.

As seen in FIG. 5, the S-bend 18 may be defined by a C-shaped bend with an arc length of 75.8-degrees and a reverse-C bend with an arc length of 60.8-degrees. It will be appreciated that a variety of other dimensions may also be provided.

The backbone 12 may be a hollow rod having a diameter of 1.00-inches and a thickness of 0.065-inches. The underarm support pole 50 and bottom support pole 54 may be hollow rods with a diameter of 0.870-inches and a thickness of 0.065-inches. The overall length of the backbone 12 may be approximately 40.50-inches. The upper section 20 may be a length of 3.69-inches. The middle section 22 may be a length of 15.90-inches. The lower section 24 may be a length of 8-inches. It will be appreciated that a variety of other dimensions may also be provided.

Referring now to FIG. 6, the outward jog 14 is defined by a bend that shifts the backbone 12 from a position underneath the user's underarm, to a position outward and to the side of the user's underarm. The bend may shift the backbone 12 horizontally, for example, from the upper section 20 placement underneath the user's underarm to the middle section 22 and lower section 24 placements approximately 2.25-inches outward and to the side of the user's underarm. It will be appreciated that a variety of other dimensions may also be provided.

For proper use, the crutch 10 should be properly fitted onto the user's body. The user then supports their weight with their hands and arms. Minimal weight should be placed on the user's axilla. The user then leans forward, placing the crutch about 1-foot in front of them. The user's body then swings forward to the crutch 10. The crutch 10 should then be moved ahead again about 1-foot to continue movement.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A medical crutch adapted for use by a human, comprising: an elongated rod having a first end positionable underneath an axilla of an average adult human and extending a length commensurate with a distance between the axilla of the average adult human and a ground to a second end when the average adult human is standing upright on the ground, the elongate rod when so positioned extending downward along a first axis from the first end to a first jog outwardly sidewards as relative to the user's human's body and then to a second jog outwardly forward as relative to the human's body, and then proceeding to a portion angled outwardly forward and down as relative to the human's body, and then proceeding downwardly to the second end along a second axis substantially parallel to the first axis;

an axillary pad attached to the first end and sized to support the average adult human's axilla;

an arm support attached to the portion of the elongated rod and sized to receive an average adult human's forearm; and a crutch foot attached to the second end of the elongated rod to contact the ground at a slip resistant face.

2. The medical crutch of claim 1 further comprising a S-curve formed in the elongate rod defined by a first bend outwardly forward relative to the human's body and a second bend backward relative to the human's body.

3. The medical crutch of claim 2 wherein the S-curve is positionable forward relative to a human's arm when the human's forearm is received in the arm support.

4. The medical crutch of claim 1 wherein the portion proceeded from the second jog is straight and angled outwardly forward and down for a length substantially equal to a length of the average adult human user's forearm.

5. The medical crutch of claim 1 wherein the first jog and second jog are positionable below the average adult human user's axilla and above the average adult human user's forearm when the average adult human user's forearm is received in the arm support.

6. The medical crutch of claim 1 wherein the axillary pad is an elastic mesh.

7. The medical crutch of claim 1 wherein the axillary pad is rotatable about an axis along the upper end of the elongate rod.

8. The medical crutch of claim 1 wherein the crutch foot is an elastomeric material having a plurality of through holes extending horizontally when the crutch is positioned upright.

9. The medical crutch of claim 1 wherein the crutch foot has a hemi-cylindrical bottom surface having a curvature axis sidewards relative to the human's body and wherein the bottom surface having traction grooves extending sidewards relative to the human's body.

10. The medical crutch of claim 1 wherein the elongated rod receives the arm support below the first jog and the second jog.

11. The medical crutch of claim 1 wherein the elongated rod is constructed of a material from a group consisting of: fiberglass reinforced plastic, carbon fiber, and aluminum.

12. A medical crutch adapted for use by a human user, comprising: a shaft having a first end adapted to be fitted underneath a user's underarm region and extending downward along a first axis to a second end contacting a ground along a second axis substantially parallel to the first axis and having a first bend outwardly sidewards as relative to a user's body, and a second bend outwardly forward as relative to the user's body, and then proceeding to a straight portion angled outwardly forward and downward to be underlying the user's forearm;

an axillary pad attached to the first end of the shaft and sized to support the user's an average adult human's axilla;

an arm support attached to the straight portion and sized to receive an average adult human's forearm; and a foot attached to the second end of the shaft.

13. The medical crutch of claim 12 wherein the arm support comprises an arm cuff and a handle grip secured to the straight portion the shaft wherein the first and second bends occur above the arm cuff and handle grip.

14. The medical crutch of claim 12 wherein the first and second bends occur above the straight portion.

15. A method of using a medical crutch comprising the steps of:

providing a medical crutch adapted for use by a human comprising an elongated rod extending downward along a first axis to a first jog outwardly sidewards relative to a user's body and a second, jog outwardly forward relative to the user's body and then downward along a second axis substantially parallel to the first axis;

an axillary pad extending from a first end of the elongated rod and sized to support the user's axilla;

an arm support attached to the elongated rod in a location between the first axis and the second axis and sized to receive a user's forearm;

a crutch foot extending from a second end of the elongated rod to contact a ground;

placing the axillary pad underneath the user's axilla such that the elongated rod extends downwards and the foot pad contacts the ground; and placing the user's forearm into the arm support.

16. The method of claim 15 wherein the elongated rod further has a S-curve defined by a first bend outwardly forward relative to the user's body and a second bend backward relative to the user's body.

17. The method of claim 15 wherein the second jog includes a straight portion disposed at an outwardly downward angle relative to the user's body and extending a length adapted to be positioned between the user's elbow and hand when the user's forearm is received in the arm support.

18. The method of claim 15 wherein the arm support comprises an arm cuff and a hand grip attached to the elongated rod.

19. The method of claim 15 wherein the first jog and second jog are positioned below the user's axilla and above the user's forearm when the user's forearm is placed in the arm support.

* * * * *